US012553306B2

(12) United States Patent
Sweeney et al.

(10) Patent No.: US 12,553,306 B2
(45) Date of Patent: Feb. 17, 2026

(54) LEAK CONTAINMENT SYSTEM

(71) Applicant: Hydril USA Distribution LLC, Houston, TX (US)

(72) Inventors: Kevin M. Sweeney, Houston, TX (US); Gregory Matthew Dunn, Houston, TX (US); Hunter Scott Haeberle, Houston, TX (US); Robert Andrew Peralez, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 18/488,896

(22) Filed: Oct. 17, 2023

(65) Prior Publication Data

US 2024/0125196 A1 Apr. 18, 2024

Related U.S. Application Data

(60) Provisional application No. 63/416,699, filed on Oct. 17, 2022.

(51) Int. Cl.

| | |
|---|---|
| ***E21B 33/08*** | (2006.01) |
| ***E21B 23/00*** | (2006.01) |
| ***E21B 33/06*** | (2006.01) |

(52) U.S. Cl.

CPC ..... *E21B 33/08* (2013.01); *E21B 23/00* (2013.01); *E21B 33/06* (2013.01)

(58) Field of Classification Search

CPC ..... E21B 33/08; E21B 23/00; E21B 33/06; E21B 37/00

See application file for complete search history.

(56) References Cited

U.S. PATENT DOCUMENTS 1,521,390 A * 12/1924 Reynolds ..... E21B 33/08 134/199
3,306,310 A * 2/1967 Grant ..... E21B 41/02 118/316
3,334,639 A * 8/1967 Grant ..... E21B 41/02 118/316

(Continued)

OTHER PUBLICATIONS

International Search Report issued in corresponding International Application No. PCT/US2023/035344 mailed Jan. 29, 2024 (4 pages).

(Continued)

*Primary Examiner* — Steven A Macdonald

(74) *Attorney, Agent, or Firm* — Osha Bergman Watanabe & Burton LLP

(57) ABSTRACT

A wellhead assembly includes a containment system having a mechanical barrier, a tertiary wiper, and a fluid jet assembly. A mechanical barrier includes a body disposed in a housing, the body having an opening extending through an axial thickness of the body. A tertiary wiper has an elastomeric body with a hole extending centrally therethrough. A fluid jet assembly includes a jet assembly body having a wall defining a cavity extending axially through the jet assembly body and an array of nozzles positioned circumferentially around the wall, wherein each nozzle has an outlet directed in a radially inward direction from the wall toward a central region in the cavity. The components of the containment system are arranged an axially stacked arrangement relative to each other.

10 Claims, 7 Drawing Sheets

(56) References Cited

U.S. PATENT DOCUMENTS 4,640,372 A * 2/1987 Davis ..... E21B 33/068 175/208
4,895,205 A * 1/1990 Thompson ..... E21B 17/006 175/84
6,102,673 A * 8/2000 Mott ..... E21B 43/36 251/324
6,173,770 B1 * 1/2001 Morrill ..... E21B 33/063 166/85.4
6,230,824 B1 * 5/2001 Peterman ..... F04B 19/003 166/359
7,409,995 B2 * 8/2008 Moynahan ..... B08B 9/023 166/88.4
8,443,893 B1 * 5/2013 Finger ..... E21B 41/0078 15/104.04
9,284,791 B2 * 3/2016 Angelle ..... E21B 12/06
10,890,032 B2 * 1/2021 Taggart ..... B08B 9/023
2001/0050185 A1 * 12/2001 Calder ..... E21B 21/001 166/53
2004/0066003 A1 * 4/2004 Griffin ..... E21B 33/062 277/325
2005/0115741 A1 6/2005 Terry et al.
2008/0023917 A1 * 1/2008 Khandoker ..... B29C 35/0222 29/888.3
2008/0105434 A1 * 5/2008 Orbell ..... E21B 33/038 166/356
2010/0294482 A1 11/2010 Araujo et al.
2011/0017511 A1 * 1/2011 Payne ..... E21B 21/08 175/7
2011/0100710 A1 5/2011 Fossli
2012/0291539 A1 11/2012 Schultz et al.
2016/0319623 A1 * 11/2016 Larson ..... E21B 33/062
2017/0074060 A1 * 3/2017 Evans ..... E21B 33/068

OTHER PUBLICATIONS

Written Opinion issued in corresponding International Application No. PCT/US2023/035344 mailed Jan. 29, 2024 (10 pages).

* cited by examiner

LEAK CONTAINMENT SYSTEM

BACKGROUND

Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole.

Using one or more mud pumps, drilling fluid may be circulated through a well system. As the drilling fluid is circulated, the drilling fluid may flow from the surface of a well, through a drill string, out the end of the drill string, and back up the well through an annulus formed around the outside of the drill string to return to the surface of the well. In many well systems, a series of different equipment may be positioned along the drilling fluid flow path (e.g., inside the drill string and outside the drill string), which may be used to regulate or monitor the flow of the drilling fluid. For example, measurement-while-drilling (MWD) tools (e.g., tools capable of evaluating physical properties such as pressure, temperature, formation parameters, etc.), drill string float valves, casing float valves, and others may be positioned along the drilling fluid flow path.

When drilling subsea wells, the drill string is extended from drilling equipment on a structure at the surface of the water (e.g., a floating or fixed platform), through wellhead equipment at the seafloor, and into the well. Often, the drill string is extended through a riser system, where the riser system may provide a conduit for the drill string between the sea surface structure and the subsea wellhead.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to systems that may include a wellhead assembly provided at a surface of a well, where the wellhead assembly has a containment system and a mud return passage fluidly connecting an annular flow path through the well to a mud return outlet. The containment system may include a mechanical barrier having a body with a variable opening disposed in a housing, where the variable opening may form part of the mud return passage. The containment system may also include a tertiary wiper having a hole extending centrally through an elastomeric body, wherein the mechanical barrier and the tertiary wiper are in an axially stacked arrangement relative to each other. Systems may also include a volume control system having an assembly of connected valves and conduits fluidly connected to the mud return outlet of the wellhead assembly. A drill string may be extended through the wellhead assembly into the well, wherein the drill string extends through the variable opening of the mechanical barrier and the hole of the tertiary wiper.

In another aspect, embodiments disclosed herein relate to wellhead assemblies that include a containment system. The containment system may include a mechanical barrier and one or more backup wiping components such as a tertiary wiper and/or a fluid jet assembly. The mechanical barrier may include a body disposed in a housing, the body having an opening extending through an axial thickness of the body. A tertiary wiper may have an elastomeric body and a hole extending centrally through the elastomeric body. The fluid jet assembly may include a jet assembly body having a wall defining a cavity extending axially through the jet assembly body and an array of nozzles positioned circumferentially around the wall, wherein each nozzle in the array of nozzles has an outlet directed in a radially inward direction from the wall toward a central region in the cavity. An inlet may be fluidly connected to the array of nozzles to spray water or other fluid through the nozzles. The components of the containment system, e.g., a mechanical barrier, tertiary wiper, and fluid jet assembly, may be in an axially stacked arrangement relative to each other.

In yet another aspect, embodiments disclosed herein relate to methods for containing returning mud in a wellhead assembly. Methods may include extending a drill string through a wellhead assembly provided at a surface of a well and through the well, wherein an annular flow path is formed between the drill string and the well. The wellhead assembly may include a mechanical barrier positioned axially between a wellhead assembly opening and a blowout preventer (BOP) stack and a mud return passage formed through the wellhead assembly and fluidly connecting the annular flow path to a mud return outlet. Methods may further include directing mud into the drill string, returning the mud through the annular flow path, and activating the mechanical barrier to constrict around the drill string and contain the mud returning from the well. Methods may further include directing contained mud from the wellhead assembly to a main mud return line.

Other aspects and advantages will be apparent from the following description and the appended claims.

BRIEF DESCRIPTION OF DRAWINGS

Wherever possible, like or identical reference numerals are used in the figures to identify common or the same elements. The figures are not necessarily to scale and certain features and certain views of the figures may be shown exaggerated in scale for purposes of clarification.

DETAILED DESCRIPTION

Embodiments disclosed herein relate generally to systems and methods for returning drilling fluids, referred to herein as mud, from a well drilling system. Additionally, or alternatively, systems and methods disclosed herein may be used for cleaning a drill string as it is used in a well drilling system. Systems and methods disclosed herein may be used with subsea well drilling systems, where a drill string is extended from a sea level platform, through a body of water, to reach a subsea well. However, systems disclosed herein may include subsystems and components that may also be used with other mud return systems, such as onshore drilling systems.

Systems disclosed herein may include a containment system having an assembly of components that may be used together with other equipment to capture mud after it has been circulated through a drill string, clean mud off downhole equipment, ensure zero discharge of well fluids to a surrounding ocean environment, and/or control the volume of fluids within the well to maintain a mud/water level or range. According to one or more embodiments, a containment system for capturing returning mud may include, but is not limited to, a fluid jet system, a mechanical barrier, and a tertiary wiper. While various types of fluid may be used in a fluid jet system according to embodiments of the present disclosure, water may be conveniently sourced from surrounding ocean environments according to one or more offshore embodiments disclosed herein. Accordingly, fluid jet systems may be described herein with reference to water as the fluid (e.g., water jet systems).

Containment systems according to embodiments of the present disclosure may be assembled with other wellhead equipment in a stacked arrangement at the surface of a well. For example, a containment system according to embodiments of the present disclosure may be assembled between a blowout preventer (BOP) and a rotating control device (RCD) in a wellhead assembly. By providing a containment system according to embodiments of the present disclosure between a BOP and RCD in a wellhead assembly, returning mud from a well system may be contained or captured by the containment system while the BOP and RCD may still be used according to their designed functions. In other embodiments, an RCD may be installed in other locations along a wellhead assembly, e.g., anywhere between the wellhead and a top guide funnel. Additionally, a volume control system may be fluidly connected to the captured mud from a containment system, which may be used to direct the captured mud to rig equipment and/or storage.

Further, systems and subsystems disclosed herein may include a range of pumping and controls units. For example, one or more components in a containment system and/or volume control system, as described herein, may have associated control units, which may send/receive signals or commands for performing an operation of the component and/or monitoring the status of an operation.

Figure 1:
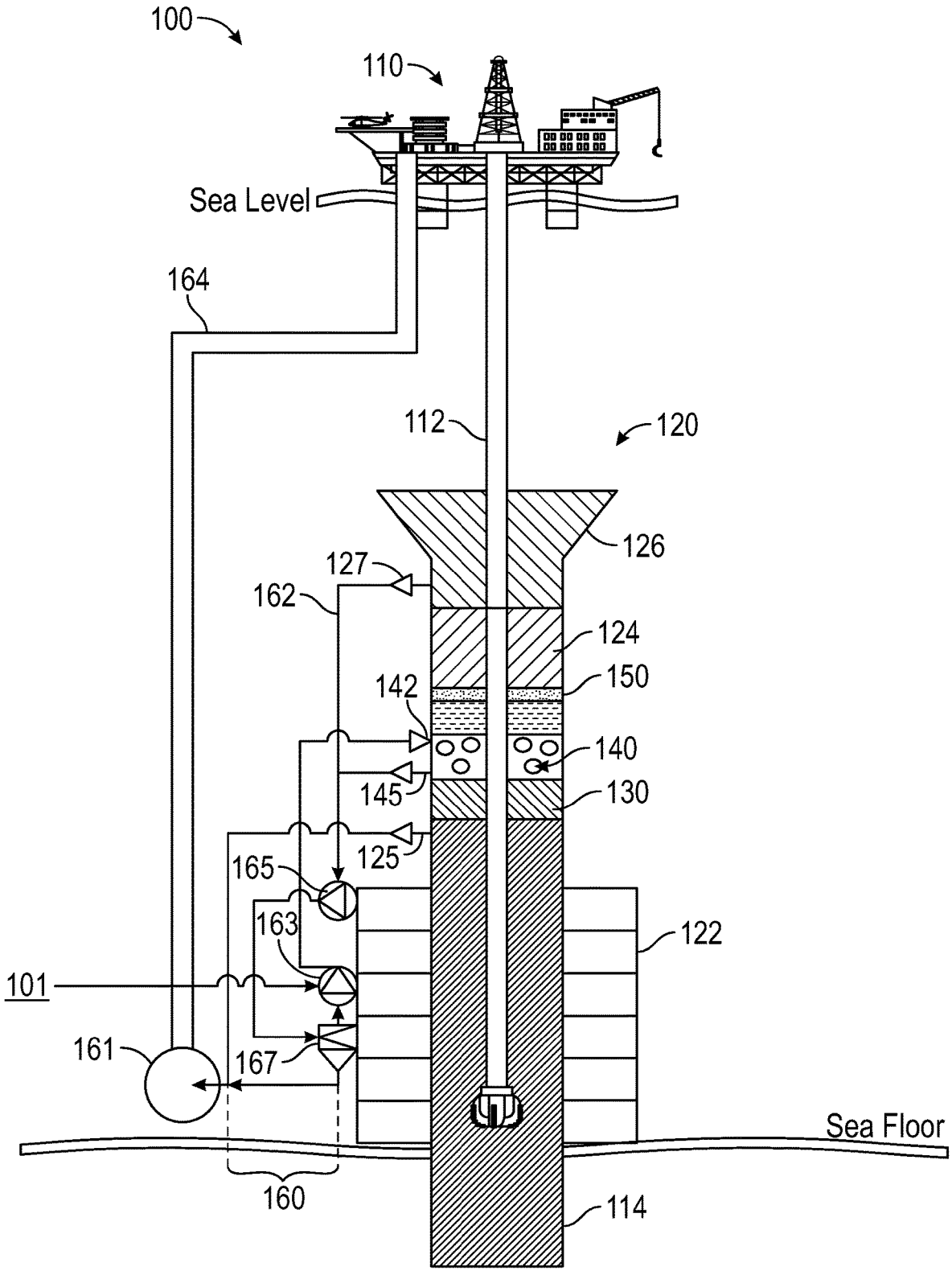
FIG. 1 shows a system according to embodiments of the present disclosure.

FIG. 1 shows an example of a system 100 according to embodiments of the present disclosure. The system 100 in FIG. 1 is an offshore drilling system. However, one or more components according to embodiments of the present disclosure may be used in other types of drilling systems. As shown in FIG. 1, the system 100 includes surface drilling equipment 110, which may be provided on a structure floating or fixed at sea level, a rig, or other platform structure capable of supporting the drilling equipment.

A drill string 112 may be extended from the surface drilling equipment to a wellhead assembly 120 provided at a surface of a well 114. In the system 100 shown in FIG. 1, the wellhead assembly 120 is provided at the sea floor, where the drill string 112 may extend from the surface drilling equipment 110 at sea level, through a body of water, to the wellhead assembly 120 installed at the sea floor.

Wellhead assemblies may generally provide a surface termination for a wellbore that incorporates facilities for installing casing hangers during the well construction phase, and a means of hanging production tubing and installing flow-control equipment for the well production phase. In one or more embodiments, the wellhead assembly 120 may include a BOP stack 122 and an RCD 124.

The BOP stack 122 may include any type of BOP known in the art. For example, a BOP may include an assembly of parts that act as a large valve at the top of a well, which may be closed to seal off fluid flow from the well. In one or more embodiments, a BOP may close over an open wellbore, seal around tubulars extending through the well (e.g., drill pipe, casing, production tubing), and/or include shearing elements that can cut through tubulars to seal off fluid flow from the well. The RCD 124 is a pressure-control device used during drilling for the purpose of making a seal around the drill string while the drill string rotates, and may be any type of RCD known in the art. For example, the RCD 124 may include one or more sealing elements configured to seal around a drill string extending therethrough, which may rotate with the drill string as the drill string is rotated and moved through the RCD.

As shown in FIG. 1, the wellhead assembly 120 also includes a containment system according to embodiments of the present disclosure, where the containment system may be fluidly connected between a BOP stack 122 and an RCD 124. The containment system may include at least one or more mechanical barriers 130, one or more water jet assemblies 140, and one or more tertiary wipers 150, which are described in more detail below. The mechanical barrier(s) 130, water jet assembly(ies) 140, and tertiary wiper(s) 150 may be assembled in an axially stacked arrangement and may be directly or indirectly connected together. In some embodiments, the containment system may be incorporated into a lower marine riser package (LMRP) or provided as a separate package to an LMRP. A LMRP typically forms the upper section of a BOP stack, which may be disconnected from a BOP, e.g., in the event of an emergency or for other operational procedures. LMRPs typically include, for example, a hydraulic connector, annular BOP, ball/flex joint, riser adapter, jumper lines for the choke, kill, and auxiliary lines, and subsea control pods.

Further, a mud return passage may be formed through the wellhead assembly 120, which may fluidly connect an annular flow path from the well to a mud return outlet 125 provided on the wellhead assembly 120. The mud return outlet 125 may have a valve fluidly connected thereto, which may selectively open/close the mud return outlet 125.

The mechanical barrier 130 may include a body disposed in a housing, where a variable opening extending through an axial thickness of the body may be formed through the body. The variable opening may be activated to be closed around the drill string (in a radially constricted position) and deactivated to a radially expanded position. When the variable opening of the mechanical barrier 130 is in a radially constricted position, the mechanical barrier 130 may act as a barrier between the returning mud from the well and sea water outside of the wellhead assembly. Additionally, when in a radially constricted position, the mechanical barrier 130 may scrape mud and/or any debris stuck along the outer surface of the drill string.

In one or more embodiments, the tertiary wiper(s) 150 may be formed of an elastomeric body having a hole extending centrally through the elastomeric body.

The water jet assembly 140 may include a jet assembly body having a wall defining a cavity extending axially through the jet assembly body and an array of nozzles positioned circumferentially around the wall, where each nozzle in the array of nozzles may be oriented to have their outlets directed in a radially inward direction from the wall toward a central region in the cavity. A water inlet may be fluidly connected to the array of nozzles to provide water from a water source to the nozzles. In one or more embodiments, a pump may be fluidly connected to the water inlet to pump water into the water inlet and through the nozzles. During operation, a drill string may be extended through the cavity in the jet assembly, where the nozzles may spray the outer surface of the drill string.

In the embodiment shown in FIG. 1, the mechanical barrier 130, the water jet assembly 140, and the tertiary wiper 150 are assembled in an axially stacked arrangement relative to each other, where the water jet assembly 140 is axially between the mechanical barrier 130 and the tertiary wiper 150. However, other arrangements may be envisioned. For example, in some embodiments, a water jet assembly may be integrated into a mechanical barrier.

In one or more embodiments, a guide funnel 126 may be provided at the wellhead assembly opening in order to guide the drill string 112 into the wellhead assembly 120, through a central passage extending through the wellhead assembly 120 to the well 114. The central passage through the wellhead assembly 120 may be formed in part by openings/holes formed through the containment system equipment. For example, a variable opening in the mechanical barrier 130, a hole formed through the tertiary wiper 150, and a cavity formed through the water jet assembly 140 may be axially aligned to partially form the central passage through the wellhead assembly. Accordingly, when the drill string 112 is extended through the central passage of the wellhead assembly 120, the drill string 112 also extends through the mechanical barrier 130, water jet assembly 140, and tertiary wiper 150.

According to embodiments of the present disclosure, a containment system in a wellhead assembly 120 may direct contained mud returning from the well 114 to a volume control system 160 via a mud return outlet 125. In one or more embodiments, a mud return outlet for the wellhead assembly may be positioned in a gravitationally lower position than the containment system in the wellhead assembly, such that returning mud contained by the containment system may be directed out of the mud return outlet to a volume control system 160. For example, in some embodiments, a mud return outlet may be positioned between the containment system and the BOP stack of the wellhead assembly. In some embodiments, a mud return outlet may be positioned in an axially stacked arrangement on a side of the mechanical barrier opposite from a water jet assembly and tertiary wiper. In some embodiments, a wellhead assembly 120 may have more than one outlet used to direct fluids from the wellhead assembly 120 to a volume control system.

According to embodiments of the present disclosure, a volume control system may generally include an assembly of connected valves and conduits fluidly connected to flow paths in the wellhead assembly 120. Volume control systems may also include one or more subsea pumps, one or more subsea separators, and/or one or more other types of flow control devices fluidly connected with the assembly of connected valves and conduits and used to control and/or process fluids from the wellhead assembly 120. Volume control systems disclosed herein may further by connected to one or more main fluid return lines, which may direct fluids from the volume control system to at least one of surface drilling equipment for reuse, storage, processing equipment to process and/or clean the returning fluids, and/or back to the wellhead assembly for reuse.

Volume control systems according to embodiments of the present disclosure may be designed and configured to work with selected equipment in a wellhead assembly and may depend on the well operation to be performed on the well. For example, a volume control system may be configured differently for wellhead assemblies having a containment system with vs without a water jet assembly. Further, volume control systems may be designed and configured based at least in part on the type of drilling system being used (e.g., offshore vs onshore, fixed platform, riserless platform, etc.). Accordingly, specific configurations of and equipment in volume control systems may vary based on the overall system needs and design to control and redirect fluids from the wellhead assembly. Different examples of volume control systems according to embodiments of the present disclosure are shown for exemplary purposes in FIGS. 1-3.

Systems

In FIG. 1, the volume control system 160 is fluidly connected to the wellhead assembly 120 via the mud return outlet 125, a jet assembly outlet 145, and a system outlet 127. However, in other embodiments, a volume control system may be connected to one or more other outlets in the wellhead assembly. The mud return outlet 125 may fluidly connect mud contained by the mechanical barrier 130 to the volume control system 160; the jet assembly outlet 145 may fluidly connect fluids (e.g., a mixture of water and returned mud) from the water jet assembly 140 to the volume control system 160; and the system outlet 127 may fluidly connect fluids from the wellhead assembly opening region (e.g., a guide funnel 126) to the volume control system 160. In one or more embodiments, directing fluid from the wellhead assembly opening region to the volume control system 160 via the system outlet 127 may be done to ensure well fluids (e.g., mud) does not escape past the guide funnel 126 into the surrounding water environment.

The volume control system 160 may further include conduits 162 (e.g., connected together piping) connecting the mud return outlet 125, the jet assembly outlet 145, and the system outlet 127 to a main fluid return line, such as a mud return riser 164. One or more pumps, such as subsea pumps 161, 163, 165, may be fluidly connected to the volume control system conduits 162 to pump fluids through one or more of the conduits 162. Further, one or more valves may be assembled along the conduits, which may be used to direct fluids through one or more selected paths through the conduits 162.

Additionally, in one or more embodiments, a volume control system 160 may include conduits and associated flow control devices configured to direct water into a water jet assembly 140 assembled with the wellhead assembly 120. For example, in the volume control system 160 shown in FIG. 1, pump 163 may be fluidly connected to a water inlet line, which may pump water 101 from the surrounding ocean environment to a water inlet 142 of the water jet assembly 140. The water jet assembly 140 may use the incoming water to spray the drill string 112 extending through the wellhead assembly. One or more valves may also be positioned along the water inlet line and/or at the water inlet 142 to control the flow of water to the water jet assembly 140.

In one or more embodiments, the volume control system 160 may also include at least one subsea separator 167. The subsea separator 167 may be used to separate mud from water and may include an intake, a mud line outlet, and a separated discharge outlet (e.g., a water outlet). In one or more embodiments, the subsea separator 167 may be a cyclone separator, which may separate water and mud from a mud/water mixture using a cyclone (swirling the mud/water mixture).

In the embodiment shown, the mud return outlet 125, the jet assembly outlet 145, and the system outlet 127 are fluidly connected to a collection conduit in the volume control system 160, where fluids exiting the outlets may merge and be directed to a pump 165. The pump 165 may pump the collected fluids from one or more of the outlet(s) to the intake of the subsea separator 167, where mud and water may be separated from the collected fluids. Mud separated by the subsea separator 167 may be directed out of the mud line outlet to the mud return riser 164, e.g., using another pump 161, to return the separated mud to drilling equipment 110 at the surface (e.g., for reuse, further processing, or storage). Water separated by the subsea separator 167 may be directed out of the discharge outlet to one or more water inlet lines fluidly connected to the water inlet 142 of the water jet assembly 140. Another pump 163 may be fluidly connected to the water inlet line to pump water from the surrounding ocean environment and/or from the separator 167 to the water jet assembly 140.

Figure 2:
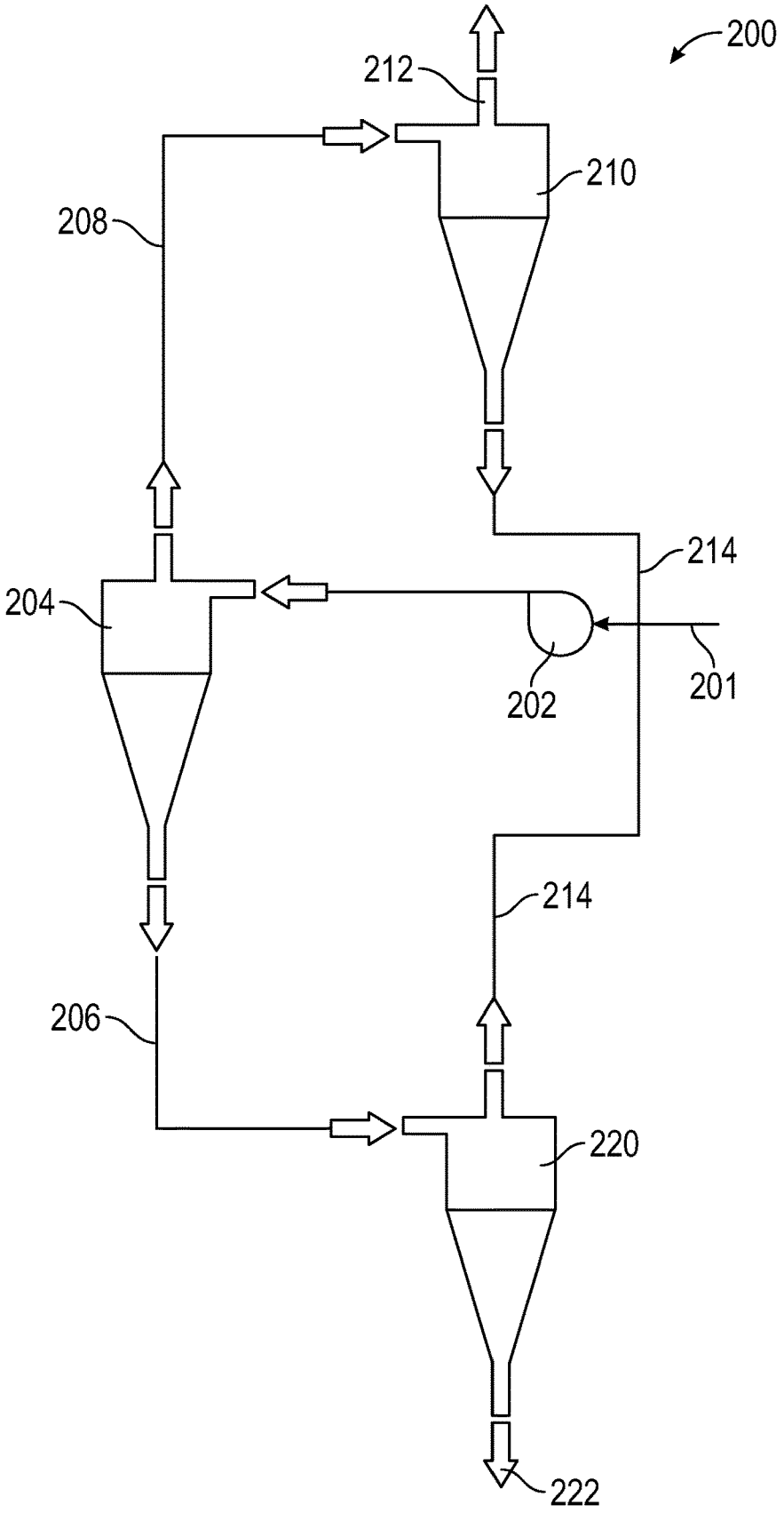
FIG. 2 shows a volume control system according to embodiments of the present disclosure.

FIG. 2 shows another example of a volume control system 200 according to embodiments of the present disclosure, where the volume control system 200 may be connected to one or more outlets of a wellhead assembly to collect fluids captured by a containment system in the wellhead assembly. The volume control system 200 includes a collection line 201, which may direct fluids collected from the wellhead assembly to a pump 202. The pump 202 may pump the collected fluids, which may be a mixture of water and mud, to a first subsea separator 204. The first subsea separator 204 includes an intake fluidly connected to the pump 202, a mud line outlet fluidly connected to a mud line 206 conduit, and a separated discharge outlet fluidly connected to a jet return line 208 conduit.

The jet return line 208 may be fluidly connected to an intake of a jet return separator 210. The jet return separator 210 may be a cyclone separator, which may swirl the incoming fluid to separate water from the incoming fluid. Separated water from the jet return separator 210 may be directed out of a water outlet of the separator to a jet system main return line 212, where the water may be eventually reused in a water jet assembly. The remaining fluid from the jet return separator 210 may be directed out of a discharge outlet to a recirculation line 214 conduit. The recirculation line 214 may direct the separated fluids back to the collection conduit 201, where the separated fluids may be recirculated through the volume control system 200 (e.g., through the first subsea separator 204).

The mud line 206 may be fluidly connected to an intake of a mud line separator 220 to direct mud fluid separated from the first subsea separator 204 to another separation process. The mud line separator 220 may be a cyclone separator, which may separate remaining water or other fluids from mud in the mud fluid. The separated mud may be directed out of a mud outlet to a main mud return line 222, while the remaining separated fluid may be directed out of a discharge outlet to the recirculation line 214.

By using the volume control systems having more than one subsea separator, such as volume control system 200 shown in FIG. 2, processing of collected fluids from a wellhead assembly may be performed subsea and used to provide recirculated fluids for reuse in the system, such as separated water for reuse in a water jet assembly.

Figure 3:
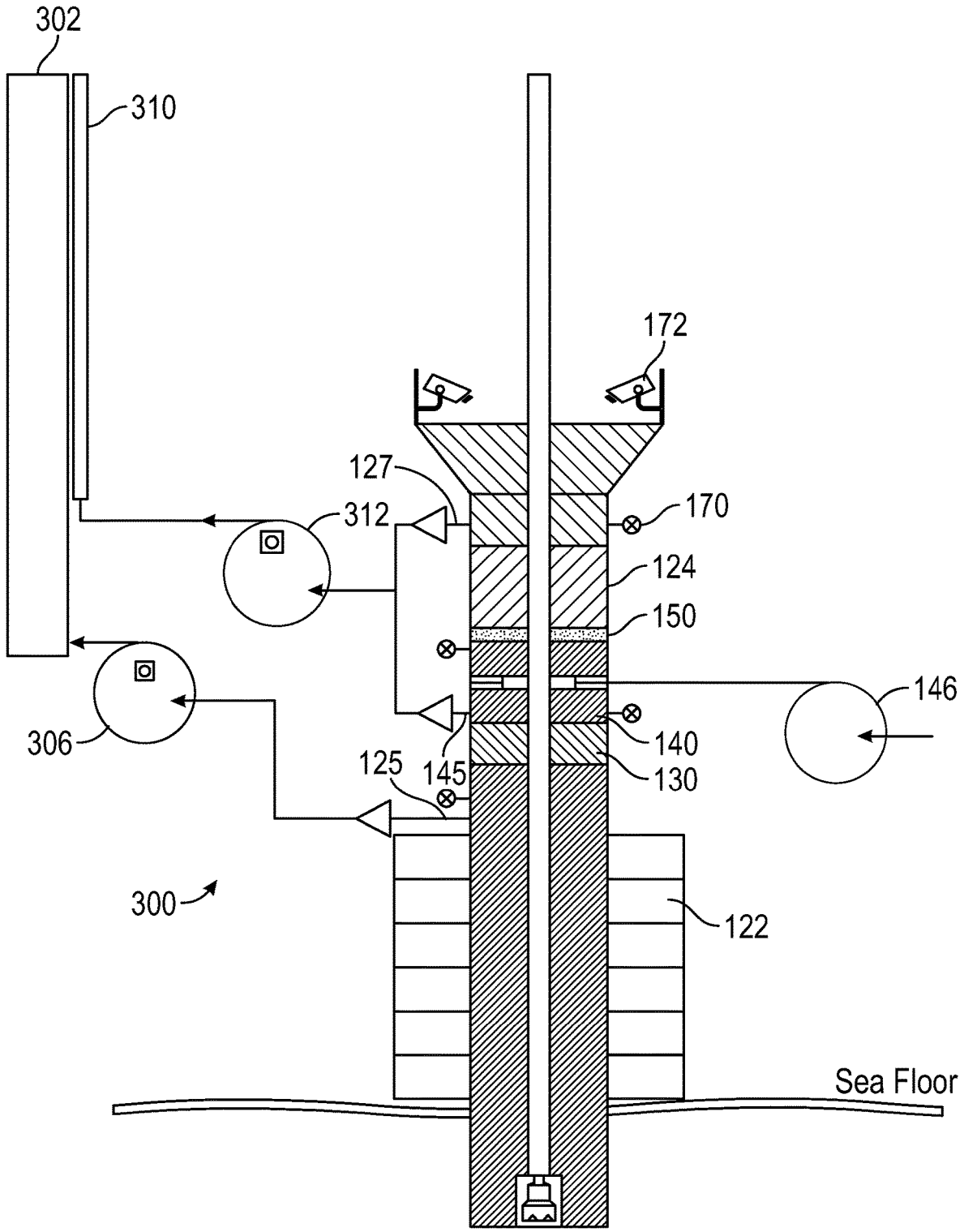
FIG. 3 shows a system according to embodiments of the present disclosure.

FIG. 3 shows another example of a volume control system 300 according to embodiments of the present disclosure, where the volume control system 300 may be connected to one or more outlets of a wellhead assembly to collect fluids captured by a containment system in the wellhead assembly. In one or more embodiments, the wellhead assembly may include one or more of the same types of equipment as shown in the wellhead assembly 120 in FIG. 1. In the embodiment shown in FIG. 3, the volume control system 300 includes a mixture return subsystem and a mud return subsystem that may be separately connected to different outlets of the wellhead assembly.

In one or more embodiments, the mud return subsystem may include a mud return riser 302 fluidly connected to a mud return outlet 125 of the wellhead assembly. In some embodiments, the mud return outlet 125 may be positioned in a gravitationally lower position along the wellhead assembly from a mechanical barrier 130 (e.g., axially between the mechanical barrier and a BOP), such that fluids contained by the mechanical barrier 130 may be directed through the mud return outlet 304 to the mud return riser 302 (e.g., to be sent to surface drilling equipment to be processed, reused, and/or stored). Further, a subsea pump 306 may be fluidly connected to the mud return riser 302, which may be used to pump the collected mud long distances (e.g., from a subsea wellhead assembly to a surface location in an offshore drilling system).

In one or more embodiments, the mixture return subsystem may include a mixture return line 310 fluidly connected to one or more outlets of components in the wellhead assembly used to contain fluids that may include a mixture of mud and water. For example, the mixture return subsystem may include a mixture return line 310 that is fluidly connected via conduits to a jet assembly outlet 145 of a water jet assembly 140 and a system outlet 127 at a wellhead assembly opening. In the water jet assembly 140, water may spray mud stuck to the drill string 112 (e.g., mud that was not scraped from the drill string by a mechanical barrier), thereby generating a mixture of mud and water. The mixture of mud and water from the water jet assembly 140 may be directed through the jet assembly outlet 145 to the connected mixture return subsystem. Similarly, because the wellhead assembly opening, such as a guide funnel, is the region of the wellhead assembly opening to the surrounding ocean environment, any mud that remains stuck along a drill string or that escapes from the wellhead assembly central passage may exit the wellhead assembly and mix with the surrounding water. A system outlet 127 provided in this location may direct this mixture of mud and water (or water if no mud has been moved to this region) to the connected mixture return subsystem.

The mixture return subsystem may further include a pump 312 fluidly connected to the mixture return line 310, which may be used to pump the collected mixture long distances, e.g., from the subsea wellhead assembly to a surface location in an offshore drilling system. In one or more embodiments, the collected mixture of water and mud may be pumped to a surface location for further processing, such as separating the mud from the mixture.

In the embodiment shown, a water inlet system is provided separately from the mixture return subsystem, where the water inlet system may direct water from a surrounding ocean environment into a water jet assembly 140, e.g., using a water inlet pump 146. In other embodiments, such as described above, a mixture return subsystem may include one or more conduits fluidly connected to a water inlet system, where fluid from the mixture return subsystem (e.g., water separated from a subsea separator in the mixture return subsystem) may be recirculated to the water jet assembly.

In some embodiments, one or more sensors 170 (e.g., flow meters, pressure sensors, temperature sensors, valve position sensors, etc.) may be positioned along the volume control system 160 (e.g., along one or more conduits and/or valves), which may be used to monitor flow through the volume control system 160. In some embodiments, one or more cameras 172 may be positioned around the system (e.g., mounted to a guide funnel and/or otherwise directed to the wellhead assembly opening). The camera(s) 172 may be used to monitor the well, e.g., to monitor movement of the drill string 112 through the wellhead assembly, monitor for leaks, etc. For example, while drilling ahead (where the drill string 112 is being operated to rotate and drill a new portion of the well), a majority of the equipment in the wellhead assembly may be on standby and/or not operating. By monitoring the drilling ahead operation with the camera(s) 172, mud escaping the wellhead assembly (e.g., stuck along the drill string) may be detected (e.g., visually from the camera images and/or recordings), in which case, the volume control system may be operated to pump fluids (e.g., mixtures of mud and water) from the wellhead assembly.

Additionally, in one or more embodiments, equipment in the volume control system 160 (e.g., valves, separator(s), and/or pumps) may have control units, which may be used to control the equipment according to commands, e.g., to open/close a valve, turn on/off a separator, and/or control a pump rate of a pump.

Mechanical Barriers

Figure 4:
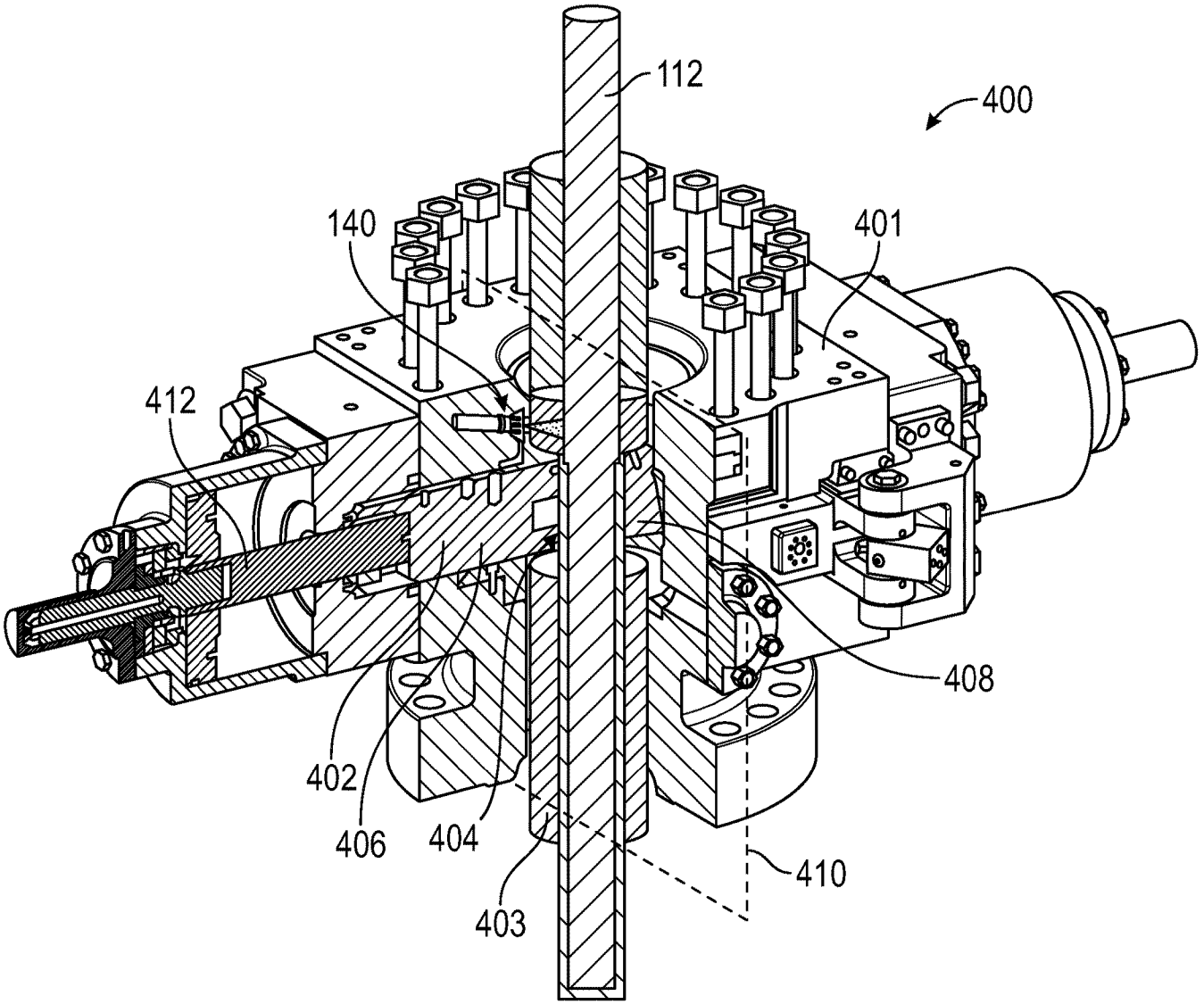
FIG. 4 shows a mechanical barrier system according to embodiments of the present disclosure.

FIG. 4 shows an example of a mechanical barrier system 400 according to one or more embodiments. The mechanical barrier system 400 may be disposed radially around a drill pipe 112 and may include a housing 401 assembly and a water jet assembly 140 assembled within the housing 401. A mechanical barrier body 402 is located at a position within the housing 401 which is axially downhole from the water jet assembly 140. The body 402 has an opening 404 which extends through an axial thickness of the body 402, with the drill pipe 112 passing axially through the opening 404. The size of the opening 404 may be variable to fit around different sizes of drill string and associated drill string components. The size of a variable opening in a mechanical barrier may be changed using various types of mechanical barrier configurations, such as described herein. In the embodiment shown in FIG. 4, the mechanical barrier system 400 may include other components, such as a ram 412, which may be used to move components within the system and change the size of the variable opening. The mechanical barrier system 400 of one or more embodiments may be used to prevent downhole fluids, such as drilling mud 403 from traveling to an upstream location, such as a location axially above of the housing 401 shown in FIG. 4.

A mechanical barrier may have a body 402 that is a single body or may be split into two or more pieces. For example, in the embodiment in FIG. 4, the body 402 of the mechanical barrier may be split into two halves, a first half 406 and a second half 408, along a radial plane 410 of the body 402. In one or more embodiments, the first half 406 and the second half 408 may each have a corresponding half-circle shaped cut out along an interfacing side, e.g., a first cut out in an interfacing side of the first half 402 and a second cut out in a corresponding interfacing side of the second half 408 of the body 402. When the first half 402 and the second half 408 are assembled along the radial plane 410 by orienting the interfacing side of the first half 406 and the corresponding interfacing side of the second half 408 to face each other, the two half-circle shaped cut outs form an opening 404. In one or more embodiments, one or more rams 412 may be located at opposite sides of the body 402 from the drill string 112, such that when the rams 412 are actuated, the rams 412 move the halves 406, 408 of the body 402 toward each other and around the drill string. For example, a first ram may apply a force to an outer side of the first half 406 of the body 402, and an additional ram (located radially opposite the first ram 412) may apply a matching force on an outer side of the second half 408 of the body 402, such that the first half 406 and the second half 408 move radially toward one another, forcing the opening 404 to contact around the drill string 112.

As will be understood by one of ordinary skill in the art, rams may be actuated using hydraulic fluid, springs, or other actuation mechanism known in the art. Other moveable features may be employed to connect the two halves of 406, 408 the body such that the opening 404 contacts the drill string 112.

Figure 5A:
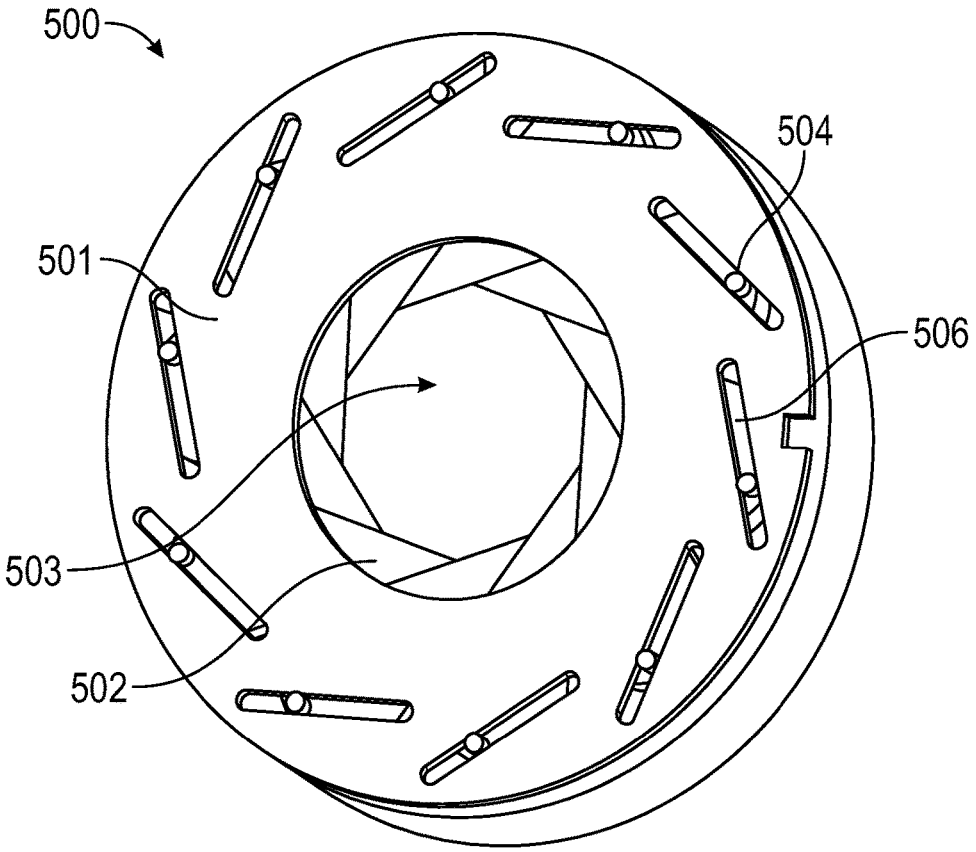
FIGS. 5A-B show mechanical barriers according to embodiments of the present disclosure.
Figure 5B:
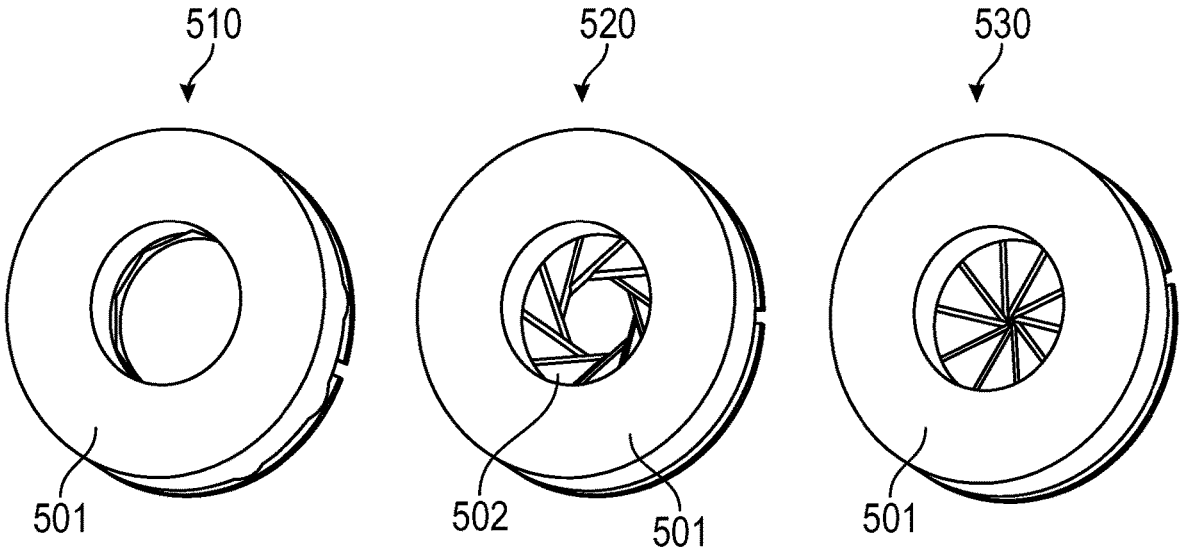

FIGS. 5A-B illustrates another example of a mechanical barrier according to embodiments of the present disclosure. The mechanical barrier 500 has a body 501 which is generally annular in shape and may include a variable opening 503. The variable opening 503 extends through an axial thickness of the body 501 and may receive a drill pipe 112 axially there through. In one or more embodiments, the variable opening 503 may be defined by a plurality of wedges moveably assembled in an annular arrangement within the body 501. An actuation mechanism 504 in communication with a pivot end 506 of the wedges 502 allows for radial constriction of the wedges 502, decreasing a diameter of the variable opening 503 accordingly.

FIG. 5B illustrates positions of the mechanical barrier 500 as the actuation mechanism 504 is engaged. For example, when the actuation mechanism 504 is not activated, the mechanical barrier may be in a radially expanded position 510, such that the variable opening 503 has a maximum diameter. In one or more embodiments, the maximum diameter may be designed to be larger than an anticipated outer diameter of a drill string (e.g., between 15 and 20 inches). As the actuation mechanism 504 is activated, the wedges 502 begin to move, such that the diameter of the variable opening 503 decreases, and the wedges 502 are in in a radially constricted position 520. In one or more embodiments, the variable opening 503 may have a diameter ranging between 3 and 6 inches when the mechanical barrier is in a radially constricted position. The actuation mechanism 504 may be operated to adjust the diameter of the variable opening 503 to fit axially around an outer diameter of the drill pipe 112. In some embodiments, the actuation mechanism 504 may be fully activated to move the wedges 502 in a closed position 530, which may be used when the drill pipe 112 is removed to close the opening through the mechanical barrier.

The actuation mechanism 504 of one or more embodiments may operate by any means known in the art, including, but not limited to hydraulics or springs. In one or more embodiments, the actuation mechanism is hydraulically operated and contains a hydraulic fluid. The hydraulic fluid may be located in a hydraulic channel located in the body of the mechanical barrier, adjacent to the pivot ends of the wedges. The hydraulic channel may be in fluid communication with a pump, such that when a hydraulic fluid is pumped through the hydraulic channels, the actuation mechanism is engaged, and a hydraulic force is generated on the pivot ends of the wedges such that the wedges move and radially constrict within the variable opening.

The wedges 502 of one or more embodiments may be made of any suitable material known in the art, capable of contacting a drill pipe and preventing or removing debris (in a scraping manner) when in the radially constricted position. For example, the wedges may be made of metal, alloys, rubber, polymers, polymer composites, or ceramic materials.

Water Jet Assemblies

Figure 6A:
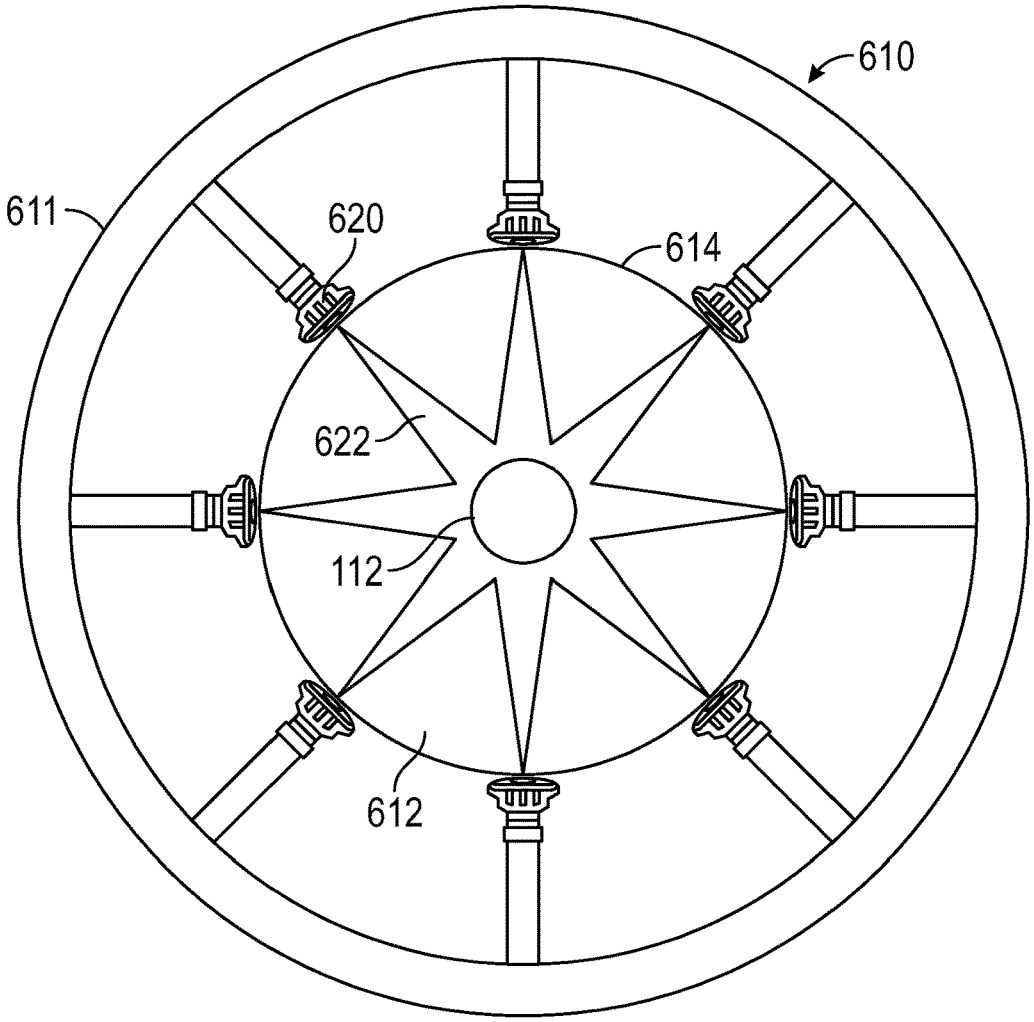
FIGS. 6A-B show water jet systems according to embodiments of the present disclosure.
Figure 6B:
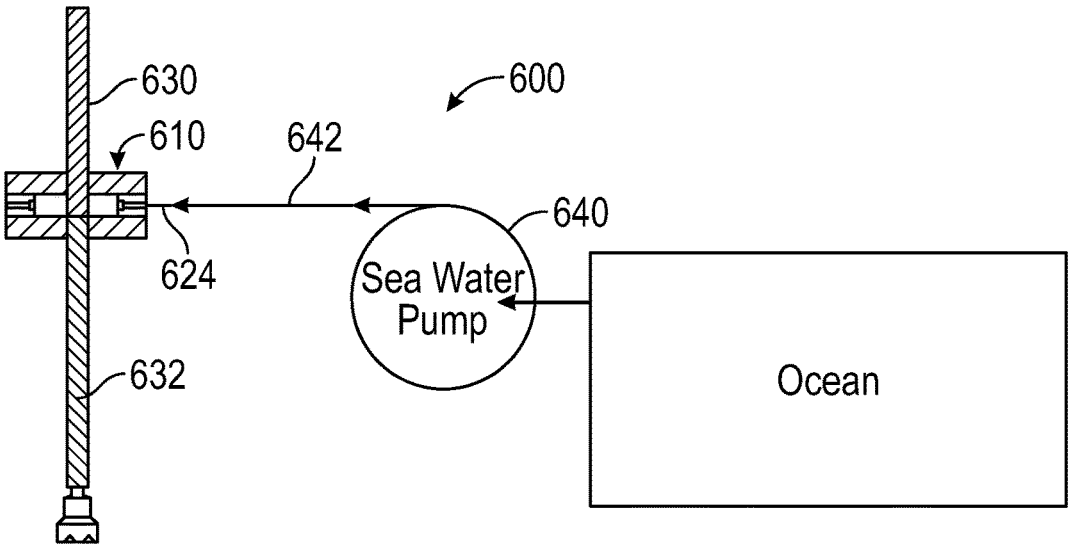

FIGS. 6A-B show an example of a water jet system 600 according to embodiments of the present disclosure. The water jet system 600 includes a water jet assembly 610, as shown in FIG. 6A. The water jet assembly 610 may include a jet assembly body 611 having a wall 614 defining a cavity 612 extending axially through by of the jet assembly body 611.

An array of nozzles 620 may be positioned circumferentially around the wall 614, wherein each nozzle 620 in the array of nozzles has an outlet directed in a radially inward direction from the wall 614 toward a central region in the cavity 612. Water jets 622 may be sprayed from the nozzles 620 to spray a drill string 112 extending through the cavity 612.

In one or more embodiments, the jet assembly body 611 may include one or more flow paths that may be fluidly connected to the nozzles 620 to direct water therethrough. Further, as best seen in FIG. 6B, a water inlet 624 may be fluidly connected to the array of nozzles 620 via the one or more flow paths formed through the jet assembly body 611, which may direct water from a water inlet line 642 into the water jet assembly 600. In one or more embodiments, a water jet system 600 may include one or more pumps 640, which may be used to pump water through the water inlet line 642 into the water jet assembly 610 at a selected pump rate (e.g., to provide a selected pressure of the water jets 622). According to embodiments of the present disclosure, a pump 640 may pump water into the water jet assembly 610 from a surrounding ocean environment (as shown in FIG. 6B), or from a recirculation line, as discussed above.

According to embodiments of the present disclosure, a mudded portion of a drill string 632 may be moved through the cavity 612 in the water jet assembly 610, where water jets 622 may spray the outer surface of the drill string to provide a clean portion of the drill string 630.

Tertiary Wipers

Figure 7:
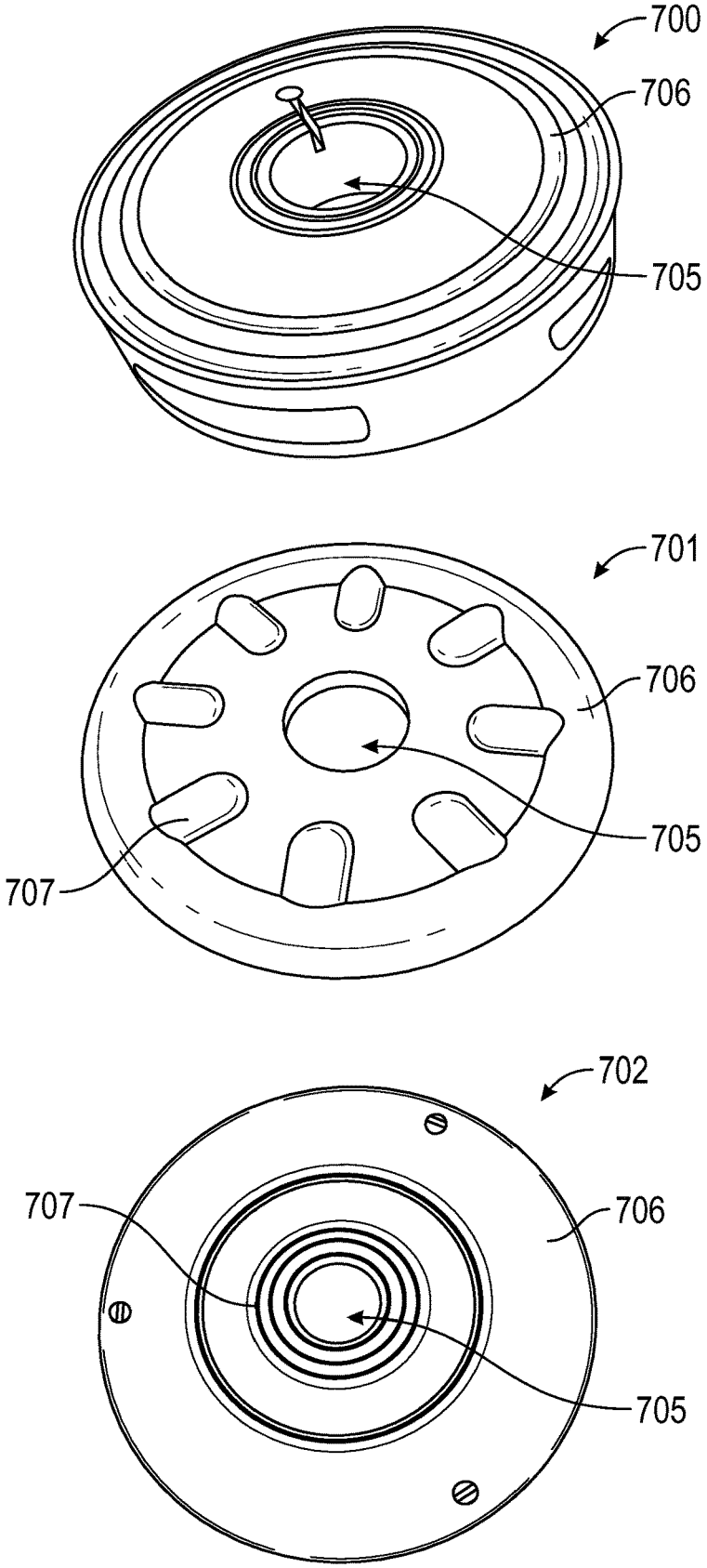
FIG. 7 show examples of tertiary wipers according to embodiments of the present disclosure.

FIG. 7 shows examples of tertiary wipers 700, 701, 702 according to embodiments of the present disclosure. Generally, a tertiary wiper 700, 701, 702 may include a hole 705 extending centrally through an annular shaped body 706. The body 706 may include one or more surface feature geometries, e.g., 707, which may be provided on one or both of the body's axial top and bottom faces, for example, to provide reinforcement to the body 706. In one or more embodiments, the body of a tertiary wiper may be formed of an elastomer material, including but not limited to natural rubber, nitrile butadiene rubber (NBR), hydrogenated nitrile butadiene rubber (HNBR), and others.

Methods

Embodiments disclosed herein may include methods for capturing fluids in a wellhead assembly, cleaning drill pipe, and/or returning mud (e.g., including cuttings returning with the mud from a drilling operation and/or water used in a cleaning operation in the wellhead assembly) to surface equipment. One or more methods disclosed herein may be used with subsea drilling systems or onshore drilling systems.

According to embodiments of the present disclosure, methods may include extending a drill string through a wellhead assembly provided at a surface of a well and extending the drill string through the well. When the drill string is positioned in the well, an annular flow path may be formed between the drill string and the well, through which mud circulating from the drill string may flow back to the surface of the well and into the wellhead assembly.

As described herein, a wellhead assembly may include a containment system, which may include one or more of a mechanical barrier, a water jet assembly, and a tertiary wiper, along with other wellhead assembly equipment, such as one or more of a BOP, RCD, LMRP, guide funnel, and other systems of flow paths, valves, and flow control devices. The equipment of the wellhead assembly may be assembled together in an axially stacked and aligned configuration to provide a central passage through the wellhead assembly. The central passage provides passage for the drill string to be extended therethrough to the well. In one or more embodiments, a mud return passage may be formed through the wellhead assembly and fluidly connect the annular flow path in the well to a mud return outlet of the wellhead assembly. The mud return passage may be separate from or partially formed by the central passage through the wellhead assembly.

With a drill string extended through the wellhead assembly and well, methods disclosed herein may include directing mud into the drill string and returning the mud through the annular flow path in the well to the wellhead assembly. In one or more embodiments, the returned mud may be directed through a mud return passage in the wellhead assembly.

With returned mud in the wellhead assembly, methods disclosed herein may include using one or more components in a containment system (assembled in the wellhead assembly) to capture and/or contain the returned mud. Examples of methods that may be used with each of a mechanical barrier, water jet assembly, and tertiary wiper are disclosed herein, where methods corresponding to use of each component may be used alone or in combination to capture the returned mud in the wellhead assembly. According to embodiments of the present disclosure, returned mud captured in the wellhead assembly may be directed to a volume control system (e.g., including an assembly of fluidly connected flow paths, flow control devices, pumps, and/or separators), where the captured mud may be directed to surface equipment, processed for reuse, stored, discharged, or other location.

In one or more embodiments where a containment system in a wellhead assembly includes one or more mechanical barrier(s), the mechanical barrier may be activated to constrict around a drill string extending therethrough, where the annular interface between the mechanical barrier and drill string may contain mud returning from the well. The mechanical barrier may have a variable opening through which the drill string may extend, where the variable opening may be actuated (e.g., using hydraulic fluid, spring activation, or any other actuation mechanism) between a radially expanded position, a radially constricted position, and a closed position. In one or more embodiments, in an activated configuration, the mechanical barrier may not form a complete seal around a drill string, but instead, the variable opening may be moved to a radially constricted position to fit around and at least partially interface the outer diameter of the drill string, such that mud may be inhibited from flowing past the mechanical barrier. Further, by activating the mechanical barrier in a radially constricted position to at least partially contact the outer diameter of the drill string, mud stuck on the drill string may be scraped off.

Mud captured by one or more mechanical barriers may be directed from the wellhead assembly to a main mud return line using a volume control system, as described herein.

In one or more embodiments where a containment system in a wellhead assembly includes one or more water jet assemblies, the water jet assembly may be operated to spray water onto a drill string extending therethrough. For example, one or more methods may include pumping water from a surrounding ocean environment to a water jet assembly, where the water may be ejected from one or more nozzles in the water jet assembly onto the drill string at a pressure sufficient to remove mud from the drill string outer surface. As described herein, a water jet assembly may include a body having a cavity formed therethrough (through which the drill string may be extended and sprayed), where the sprayed water and any mud removed by the sprayed water may be collected (e.g., in one or more regions of the water jet body and/or in a contained region gravitationally below the water jet assembly). The resulting mixture of mud and water may be directed out of a jet assembly outlet (e.g., using an externally connected pump).

In one or more embodiments where a containment system in a wellhead assembly includes one or more tertiary wipers, the tertiary wiper(s) may be sized to fit around a drill string, such that the tertiary wiper(s) may contact and wipe the outer surface of the drill string extending therethrough.

According to embodiments of the present disclosure, one or more of three major drill string operations may be performed for drilling operations, which may include drilling ahead, pulling out of hole (POOH), and run in hole (RIH).

When drilling ahead, a drill bit attached at an end of the drill string may be rotated via the connected drill string to drill a new part of the well. According to methods of the present disclosure, during one or more drilling ahead operations, a mechanical barrier is not activated (not closed around the drill string extending therethrough).

When a drill string is RIH, the drill string may be moved into the well, e.g., moving in an axially downward direction through the wellhead assembly to be extended farther into the well. In one or more RIH operations, a mechanical barrier may be activated to a radially constricted position while the drill string is being RIH. In such embodiments, when the mechanical barrier is closed around the drill string, the mechanical barrier may provide a non-sealing physical barrier between the drilling mud below the mechanical barrier and a sea water column inside of an RCD positioned axially above the mechanical barrier. Additionally, in one or more RIH operations, a volume control system fluidly connected to one or more outlets of the wellhead assembly may be used to direct fluids out of the wellhead assembly in a controlled manner so that returning mud does not escape the wellhead assembly into the surrounding environment (e.g., out of a guide funnel).

According to one or more methods of the present disclosure, when a drill string is POOH, one or more or all components in a containment system and volume control system may be functioning. For example, in one or more methods, while POOH, a mechanical barrier may be activated to close around the drill string and provide a non-sealing physical barrier between the returning mud and a sea water column above, as well as provide a scraping effect on the drill string as it is pulled upwards (in a direction out of the well). This barrier may help scrape coarse cuttings and anything else that is stuck around the outer surface of the drill string. Additionally, or alternatively, while POOH, a water jet system may be activated to jet water through nozzles in a water jet assembly and onto the drill string in order to blast the remaining mud off of the drill string. This blasting of the drill string may create a mixture of mud and water, which may be held in a mixture zone in the water jet assembly. In one or more embodiments, the volume of the mixture in the mixture zone may be maintained by the volume control system (e.g., by pumping fluid out of a fluidly connected jet assembly outlet) so that the mud does not make it to the wellhead assembly opening region (e.g., does not make it past a guide funnel). Additionally, or alternatively, while POOH, one or more tertiary wipers may be used as a third scraping means for wiping remnant mud stuck to the drill string before it enters the ocean.

In one or more embodiments, while POOH, a mechanical barrier in the wellhead assembly is activated to close around the drill string, a water jet assembly in the wellhead assembly is activated to spray the drill string, and a tertiary wiper in the wellhead assembly wipes around the drill string.

In one or more drilling operations, a water jet system may be used to clean all drill strings, downhole tools and/or other equipment connected to the drill string used during the drilling operation. In one or more embodiments, along with a water jet system, a tertiary wiper may be available as a back-up system in case of malfunction of the water jet system, where the tertiary wiper may wipe the drill pipe and tool joints of the drill string to remove fluids and particles stuck around the drill string. A fluidly connected volume control system may be used to remove all collected fluids (e.g., sometimes referred to as slop mud) generated by the water jet system as well as to remove any mud that has flowed past an RCD during drilling ahead. In one or more embodiments, during both tripping in (RIH) and tripping out (POOH), one or more mechanical barriers may be activated to close around the drill string to mitigate the mixing potential of the system.

One skilled in the art may appreciate that different combinations of equipment in a containment system and/or volume control system may be used to perform different operations, depending on, for example, the type of drilling operation being conducted and the drilling system being used.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. An assembly, comprising:

a mechanical barrier, comprising:

a housing; and a body disposed in the housing, the body having an opening extending through an axial thickness of the body; and a tertiary wiper comprising:

an elastomeric body; and a hole extending centrally through the elastomeric body;

a water jet assembly, comprising:

a jet assembly body having a wall defining a cavity extending axially through the jet assembly body;

an array of nozzles positioned circumferentially around the wall, wherein each nozzle in the array of nozzles comprises an outlet directed in a radially inward direction from the wall toward a central region in the cavity;

a water inlet fluidly connected to the array of nozzles, wherein the mechanical barrier, the tertiary wiper, and the water jet assembly are in an axially stacked arrangement relative to each other;

a mud return passage extending through the assembly and fluidly connected to a mud return outlet, wherein the mud return outlet is positioned in the axially stacked arrangement on a side of the mechanical barrier opposite from the water jet assembly and the tertiary wiper; and a volume control system fluidly connected to the mud return outlet and to a water inlet line, wherein the volume control system comprises a subsea separator configured to receive a mud and water mixture from the mud return outlet, separate the mud from the water, and provide the water to the water jet assembly.

2. The assembly of claim 1, wherein the body of the mechanical barrier further comprises:

two halves assembled along a radial plane, each half having a cut out along an interfacing side, wherein the interfacing sides of the two halves are oriented to face each other, and wherein the cut out of each half form the opening.

3. The assembly of claim 2, further comprising:

rams located at opposite sides of the body; and an actuation mechanism comprising hydraulic fluid, wherein the rams are actuated by the actuation mechanism to move the two halves together to provide the opening.

4. The assembly of claim 1, wherein the assembly is part of a lower marine riser package (LMRP) mounted to a blowout preventer (BOP) stack, and wherein the mechanical barrier is axially positioned between the BOP stack and the water jet assembly.

5. The assembly of claim 1, further comprising a rotating control device (RCD), wherein the tertiary wiper is axially positioned between the RCD and the water jet assembly.

6. The assembly of claim 1, wherein the tertiary wiper, the water jet assembly, and the mechanical barrier are directly connected together in the axially stacked arrangement.

7. The assembly of claim 1, further comprising a guide funnel positioned at an assembly opening.

8. The assembly of claim 7, further comprising a monitoring device connected to the guide funnel and directed towards the assembly opening.

9. The assembly of claim 1, further comprising:

at least one additional outlet, fluidly connected to the volume control system.

10. The assembly of claim 9, wherein the at least one additional outlet comprises a system outlet fluidly connected to an assembly opening at an end of the axially stacked arrangement opposite the mud return outlet.

* * * * *